US008337264B2

(12) United States Patent
Boebel

(10) Patent No.: US 8,337,264 B2
(45) Date of Patent: Dec. 25, 2012

(54) OUTBOARD MOTOR FOR A BOAT

(75) Inventor: Friedrich Boebel, Eurasburg (DE)

(73) Assignee: Torqeedo GmbH, Starnberg (DE)

( * ) Notice: Subject to any disclaimer, the term of this patent is extended or adjusted under 35 U.S.C. 154(b) by 0 days.

(21) Appl. No.: 11/619,285

(22) Filed: Jan. 3, 2007

(65) Prior Publication Data

US 2007/0155256 A1 Jul. 5, 2007

(30) Foreign Application Priority Data

Jan. 5, 2006 (DE) ..... 10 2006 001 010
Feb. 27, 2006 (EP) ..... 06003961

(51) Int. Cl.
*B63H 21/17* (2006.01)

(52) U.S. Cl. ..... 440/6

(58) Field of Classification Search ..... 440/6
See application file for complete search history.

(56) References Cited

U.S. PATENT DOCUMENTS 3,315,631 A * 4/1967 Bass ..... 440/6
4,789,135 A * 12/1988 Watanabe ..... 254/362
6,166,525 A * 12/2000 Crook ..... 322/11
6,622,618 B1 * 9/2003 Glucksman et al. ..... 99/495
7,454,127 B2 * 11/2008 Simofi-Ilyes et al. ..... 388/806
7,652,900 B2 * 1/2010 Fukaya et al. ..... 363/132
7,667,342 B2 * 2/2010 Matsumoto et al. ..... 290/40 C

FOREIGN PATENT DOCUMENTS

JP 2005-162055 A 6/2005
WO WO 2005/043713 A2 * 5/2005

OTHER PUBLICATIONS

European Search Report dated Jun. 6, 2006 with English translation of relevant portion (five (5) pages).

* cited by examiner

*Primary Examiner* — Stephen Avila
(74) *Attorney, Agent, or Firm* — Crowell & Moring LLP

(57) ABSTRACT

An outboard drive for a boat, having an electric motor, a power supply line and a contact-making apparatus, connected to the power supply line for connecting a DC voltage source. The outboard drive has a space for accommodating the DC voltage source. The contact-making apparatus has a first and a second contact stage, and a current limitation element is connected between the DC voltage source and the power supply line in the first contact stage.

9 Claims, 2 Drawing Sheets

OUTBOARD MOTOR FOR A BOAT

BACKGROUND AND SUMMARY OF THE INVENTION

The invention relates to an outboard drive for a boat, having an electric motor and having a power supply line and a contact-making apparatus, which is connected to the power supply line, for connecting a DC voltage source.

Outboard drives are among the most widely distributed drive systems for smaller boats. An outboard drive is a complete drive unit with a motor, propeller and supporting systems, such as a transmission or an electronic control unit, for example. The outboard drive is conventionally fitted to the stern of the boat.

Outboard drives are either offered for sale with gasoline engines or with electric motors. In outboard drives with an electric motor, the power supply generally takes place via batteries or rechargeable batteries. When the power supply is connected, for example when a rechargeable battery is connected, high charge current pulses may be brought about owing to buffer capacitors in the systems connected upstream of the electric motor, which high charge current pulses may lead to sparking and to the outboard drive being impaired or even damaged.

For reasons of safety, electric boat motors are often designed for the low-voltage range up to 42V. The single source of hazard in a circuit below 42 volts is damaged contacts. These may lead to local overheating and therefore to the risk of a fire.

Electronically commutated electric motors are shielded on the input side from the battery by capacitors in order to buffer away harmonics and keep them at a distance from the electronics. When the battery is connected, these buffer capacitors may cause high charge current pulses, which may lead to sparking and contact erosion.

One object of the present invention is therefore to develop an outboard drive of the type mentioned at the outset such that the abovementioned problems are avoided as much as possible.

This object is achieved by an outboard drive for a boat, having an electric motor and having a power supply line and a contact-making apparatus, which is connected to the power supply line, for connecting a DC voltage source, the contact-making apparatus having a first and a second contact stage, a current limitation element being connected between the DC voltage source and the power supply line in the first contact stage.

The outboard drive is equipped with a contact-making apparatus, which produces the contact between the DC voltage source and the power supply line. According to the invention, the contact-making apparatus has at least two different contact stages. In the first contact stage, a current limitation element is connected between the connected DC voltage source and the power supply line. The current limitation element, for example a nonreactive resistance, limits the current flowing in the first contact stage such that the capacitances contained in the connected load circuit, i.e. in the electric motor and in the other electrical components, in particular buffer capacitors, can be charged slowly without current peaks and charge current pulses occurring.

The term "current limitation element" will be understood below to mean active or passive electrical or electronic components which limit the current flowing from the DC voltage source to the power supply line when averaged over time. This can take place in particular by a nonreactive resistance being used as the current limitation element or by the current averaged over time being limited by a pulse generator which permits current flow only at certain times. In the latter case, the maximum current can be set via the pulse length and/or via the pulse repetition rate.

In the second contact stage, the DC voltage source is preferably connected directly to the power supply line. This means that no active or passive electrical components, such as resistances or inductances, for example, are connected between the DC voltage source and the power supply line apart from the unavoidable nonreactive resistance of the electrical lines of the contact-making apparatus. However, it has also proven favorable to provide a switching element, for example a MOSFET, between the DC voltage source and the power supply line, which switching element is open in the first contact stage and suppresses current flow and is closed in the second contact stage in order that the current can flow via the switching element. The nonreactive resistance of the switching element in the current-conducting position should in this case be as low as possible.

In outboard drives with an electric motor, the power supply generally takes place via batteries or rechargeable batteries, for example lead-acid rechargeable batteries. Such rechargeable batteries are, however, often relatively large and heavy, with the result that, until now, they have generally not been fitted directly on the outboard drive but accommodated in the boat. However, mounting the rechargeable batteries in the boat necessarily reduces the amount of space available for passengers or cargo within the boat.

In addition, relatively long power supply lines from the rechargeable batteries located in the interior of the boat to the outboard drive fixed on the outside to the stern of the boat are necessary. The long electrical line paths have a negative effect on the electromagnetic compatibility, however.

In addition, the electrical lines need to be designed for the high currents, of up to 100 A, for example, which may flow during operation of electric motors. Owing to the high currents, relatively high 12R losses occur in all current-carrying lines if the line lengths are not kept as short as possible and/or the line cross sections are not kept as large as possible. Large line cross sections are associated with the disadvantage of a high weight, however.

Preferably, the outboard drive therefore has a space for accommodating the DC voltage source, i.e. the DC voltage source is integrated in the outboard drive or can be integrated in it. Particularly preferably, a suitable accommodating apparatus for the DC voltage source is provided for this purpose, in which the DC voltage source can be accommodated and fixed.

Owing to the arrangement of the DC voltage source as part of the outboard drive, the electrical line paths between the DC voltage source and the electric motor or the electrical components associated with the electric motor are shortened as much as possible. Owing to the short line paths, the nonreactive resistance in the cables is kept low without particularly large cable cross sections being required. The mentioned problem associated with weight in cables which carry high currents of up to 100 A is thereby avoided.

In addition, the connection of the electric motor to the DC voltage source is optimized in terms of electromagnetic compatibility.

Preferably, galvanic elements, primary cells or secondary cells and particularly preferably rechargeable batteries, very particularly preferably lithium-manganese rechargeable batteries, are used as the DC voltage source.

In one advantageous variant of the invention, the outboard drive has a housing, which houses at least part of the outboard drive. In this case, space for accommodating a DC voltage source as the energy source for the electric motor is provided within the housing. The DC voltage source is integrated in the outboard drive and protected against external influences, in particular against spray water, by the housing.

The outboard drive preferably has an upper part, an underwater part and a shaft connecting the upper part and the underwater part, in which case the housing houses at least part of the upper part. The DC voltage source is in this case accommodated in the upper part, more precisely in the part of the upper part which is provided with the housing.

In another preferred embodiment, the shaft is used for accommodating the DC voltage source. The DC voltage source is found in the shaft connecting the upper part and the underwater part. It is likewise possible for the DC voltage source to be arranged in the shaft and in the upper part. For example, the DC voltage source may comprise a plurality of individual cells, some of the cells being accommodated in the shaft and other cells being accommodated in the upper part. In principle, it is also conceivable for the DC voltage source or part thereof to be accommodated in the underwater part, but it is often only possible to achieve such a configuration with difficulty for reasons of space.

The housing can extend over the entire outboard drive or only surround part of the outboard drive. Likewise, a plurality of housings may be provided, for example a housing which houses the upper part and a separate housing for the shaft.

In one further preferred embodiment, the DC voltage source is provided with contacts, which can be connected directly to the contact-making apparatus. In particular, the contacts are fitted directly to the DC voltage source such that no further electrical lines between the contact-making apparatus and the DC voltage source need to be provided.

The contact-making apparatus advantageously has, in addition to a connection for the negative terminal of the DC voltage source, two connection contacts, a first and a second connection contact, for the positive terminal of the DC voltage source, the current limitation element being connected to the first connection contact. The second connection contact, on the other hand, is connected directly to the power supply line. In this embodiment, the two contact stages are realized by the connection to two different connection contacts. The positive terminal of the DC voltage source can be connected to the first and/or the second connection contact. When the positive terminal of the DC voltage source is in contact with the first connection contact, the current flows via a current limitation element, for example a nonreactive resistance, with the result that the electrical and electronic components located in the outboard drive are protected against high current pulses.

When the current DC voltage source is connected, first a conductive connection is produced with the first connection contact. In a second phase, the second contact stage, the connection to the second connection contact of the contact-making apparatus takes place, which connection contact does not have any current-limiting elements.

It is also possible to configure the first and the second connection contact such that, in the second contact stage, the DC voltage source is connected to the two connection contacts, the current limitation element connected to the first connection contact being bridged by the connection between the DC voltage source and the second connection contact.

It is essential to the invention that the connection between the DC voltage source and the power supply line takes place at least in two stages. In the first contact stage, the current flow is in this case limited. The two contact stages can, as explained above, be implemented by separate connection contacts, which are connected successively to the DC voltage source. The two-stage nature of the system can, however, also be achieved by a suitable circuit provided in the contact-making apparatus, which circuit switches a current limitation element between the connection contact and the power supply line only in the first contact stage and allows for unlimited current flow between the connection contact and the power supply line in the second contact stage.

It has proven to be favorable and sufficient to use precisely two contact stages. Depending on the design of the downstream electrical and electronic components, however, it may also be expedient to reduce or cancel the current limitation in more than two stages or to provide continuous reduction of the current limitation. The latter can take place, for example, by virtue of the fact that an electronic pulse generator is provided as the current limitation element, which pulse generator only allows current flow during the pulses. Owing to the pulse width and/or the pulse repetition rate continuously being increased, the average current flow can be increased continuously.

When the DC voltage source is connected in the space provided for it to be accommodated, it is advantageous for initially the first contact stage of the contact-making apparatus and then the second contact stage to be connected, i.e. the two contact stages run one after the other. The contact-making apparatus is preferably designed such that, when the DC voltage source is connected to the second contact stage, prior to this, a connection between the DC voltage source and the first contact stage has always been produced. This ensures that, in an initial phase, at first only a current which is limited by the current limitation element always flows. The current limitation is only bridged or circumvented when there is a switchover to the second contact stage.

It is not absolutely necessary to provide the contact-making apparatus with separate connection contacts in order to produce a first and a second contact stage. It is likewise possible to connect the positive terminal of the DC voltage source to the power supply line only via one connection contact, this connection contact in turn being connected to a current limitation element. Switching over from the first to the second contact stage then takes place, for example, by the current limitation element being bridged. Bridging of the current limitation element preferably takes place automatically and/or under time control.

In one preferred embodiment, the contact-making apparatus has a first and a second connection contact, a current-limiting resistance being connected between the first connection contact and the power supply line, while a switching element, for example a MOSFET, is connected between the second connection contact and the power supply line.

The positive terminal of the DC voltage source is connected both to the first and to the second connection contact. The negative terminal of the DC voltage source is likewise connected to the corresponding connection contact of the contact-making apparatus. In this first contact stage, the switching element is open, with the result that no current flows via the second connection contact. The line located between the first connection contact and the power supply line with the current limitation element acts as the measurement line in order to establish whether the DC voltage source has been properly connected to the connection contacts. Since the first line is designed to have a current limitation element and therefore only a low current flows, no sparking occurs when the DC voltage source is connected to the first connection contact.

If the DC voltage source is connected properly to the contact-making apparatus, this is detected via the first line acting as the measurement line, and the switching element is closed. For this purpose, a microcontroller is provided, for example, which microcontroller drives the switching element as a function of the input signal from the measurement line. In this second contact stage, the current then flows directly whilst bypassing the current limitation element via the second connection contact.

An essential feature of the contact-making apparatus according to the invention is the fact that the current is limited in the first contact stage in order to avoid current peaks and charge current pulses. After this initial phase, the current limitation is canceled. The transition between the first, current-limited contact stage and the second contact stage may take place abruptly in one stage or else via a plurality of stages, in which the current limitation is in each case reduced. Continuous reduction of the current limitation from an initial value down to zero is also possible.

A first and a second connection contact are preferably arranged in series such that, when the DC voltage source is connected to the second connection contact, it necessarily bypasses the first connection contact, the contact between the DC voltage source and the first connection contact being closed.

The accommodation and the connection of the DC voltage source can also be achieved via a bayonet-type connection. For this purpose, the DC voltage source is first connected to the contact-making apparatus by a movement in a first direction, the first contact stage being closed. Only once the first contact stage has been closed is it possible to bring the DC voltage source into a second position, the DC voltage source coming into contact with the second contact stage.

The space for accommodating the DC voltage source is advantageously designed such that the DC voltage source can only be accommodated in a defined position. In this manner, a connection of the DC voltage source with incorrect polarity is prevented.

BRIEF DESCRIPTION OF THE DRAWINGS

The invention and further details on the invention will be explained in more detail below with reference to exemplary embodiments illustrated in the drawings, in which.

DETAILED DESCRIPTION OF THE DRAWINGS

Figure 1:
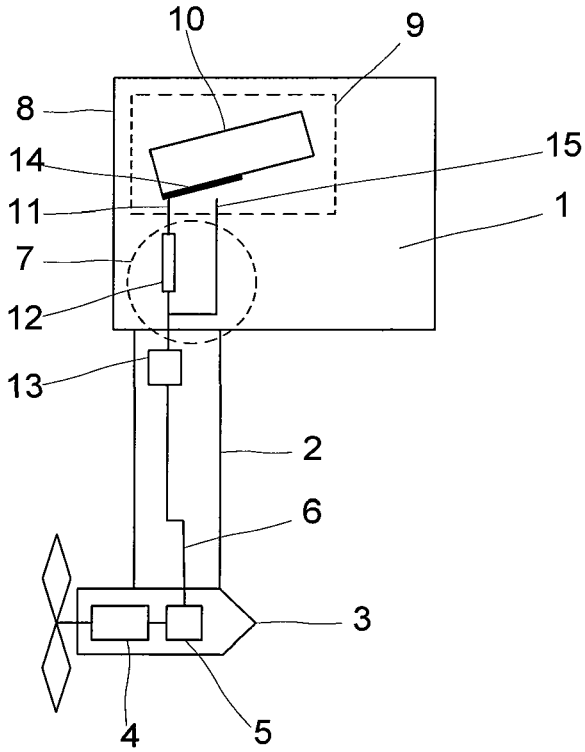
FIG. 1 is a schematic elevational view showing an outboard drive according to the invention, the rechargeable battery being connected to the first contact stage of the contact-making apparatus.

The figures show an outboard drive according to the invention. The outboard drive shown in FIGS. 1 and 2 has an upper part 1, a shaft 2 and an underwater part 3. An electric motor 4 and a control unit 5 for driving the electric motor 4 are located in the underwater part 3. The electric motor 4 and the control unit 5 can be supplied with current via a power supply line 6, which is passed through the shaft 2 to the upper part 1. For this purpose, a contact-making apparatus 7 is connected to the power supply line 6. A protective circuit 13 protects all the electronic components in the event of any possible faulty operations, such as overvoltages, for example.

The upper part 1 has a housing 8 and, within the housing 8, an accommodating device 9 for a rechargeable battery 10.

When the rechargeable battery 10 is connected to the contact-making apparatus 7, the rechargeable battery 10 is inserted into the accommodating device 9, the positive terminal 14 of the rechargeable battery 10 coming into contact with the connection 11 of the contact-making apparatus 7. A nonreactive resistance 12 is connected between the connection 11 and the power supply line 6 and limits the current flowing from the rechargeable battery 10 to the electric motor 4 or to the control unit 5. The negative pole (not illustrated) of the rechargeable battery 10 is connected to the corresponding connection contact. In this first phase of the connection of the rechargeable battery 10, shown in FIG. 1, the capacitances contained in the control unit 5 and the protective circuit 13 are slowly charged without charge current peaks occurring.

Figure 2:
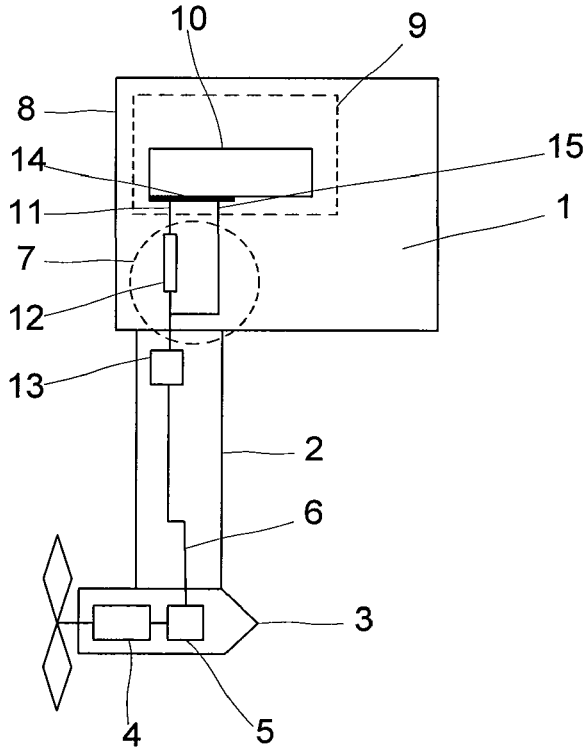
FIG. 2 is a similar view of the outboard drive as shown in FIG. 1, but with the rechargeable battery being connected to the second contact stage of the contact-making apparatus.

If the rechargeable battery 10, as shown in FIG. 2, is brought into its final position, the positive terminal 14 of the rechargeable battery 10 comes into contact with the second connection 15 of the contact-making apparatus 7. As a result, the nonreactive resistance 12 is bridged and the current limitation provided in the first phase is dispensed with.

The accommodating device 9 is designed such that the rechargeable battery 10 is always first connected to the first connection 11 when inserted, i.e. a current limited by the nonreactive resistance 12 at first always flows.

Instead of the two connections 11 and 15 it is also possible only to provide one connection without a current limitation element and to produce the two-stage contact-making process such that the positive terminal of the rechargeable battery has a contact tongue having two zones with different nonreactive resistance values. In this case, the power supply line in the first contact stage would be connected first to the zone of the contact tongue which has a higher nonreactive resistance for current limitation purposes. The increase in resistance can take place, for example, by a suitable coating on the contact tongue of the positive terminal. In the second contact stage, the power supply line is connected to the zone of the contact tongue of the positive terminal which has no current limitation element.

Figure 3:
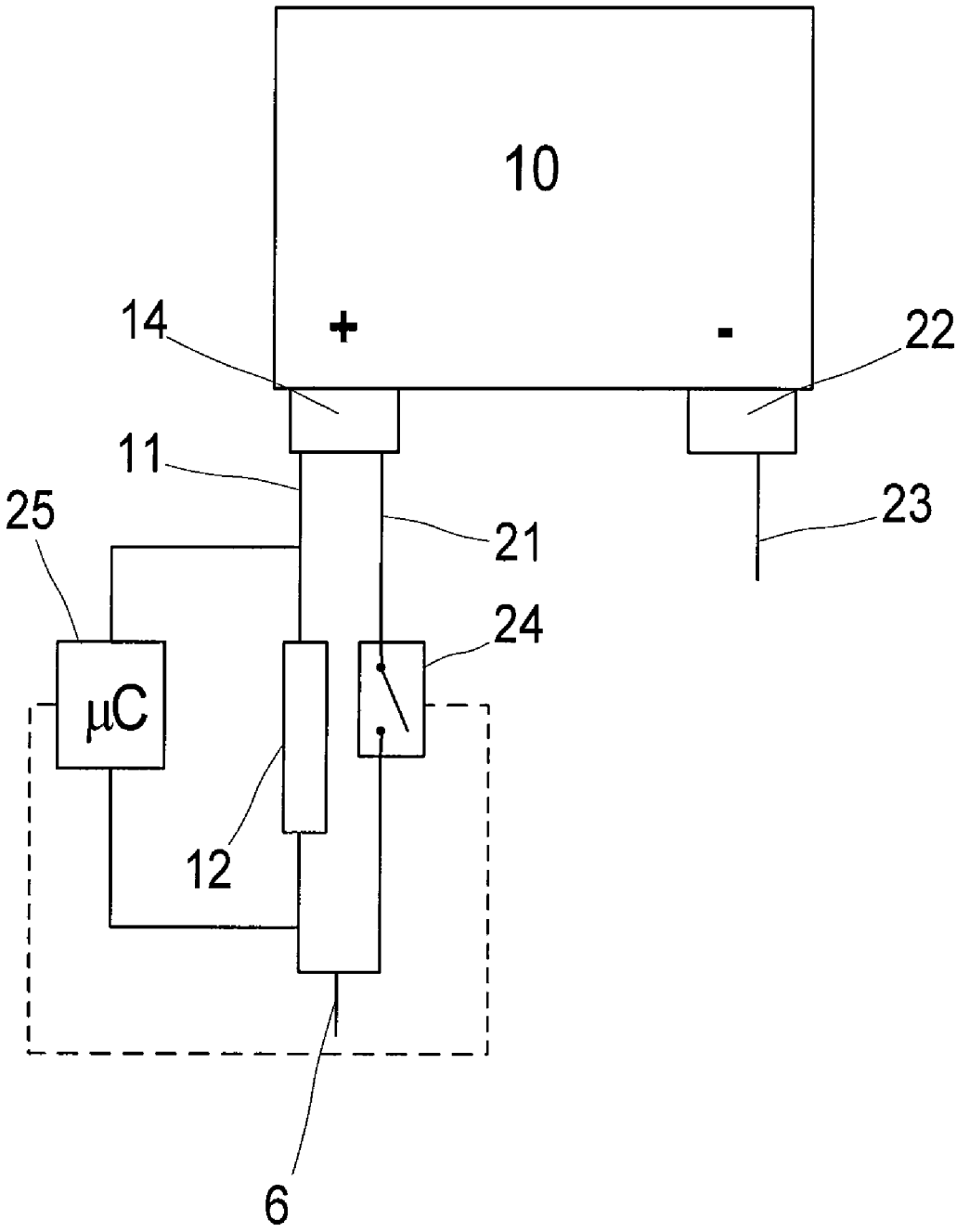
FIG. 3 is a schematic view showing an alternative embodiment of the invention as relates to the contact-making apparatus.

FIG. 3 shows an alternative embodiment of the contact-making apparatus according to the invention. A connection line 11 with a nonreactive resistance 12 is connected to the positive terminal 14 of the rechargeable battery 10. At the same time, a further line 21 is connected to the positive terminal 14. The lines 11 and 21 end in a common plug, with the result that they can always only be connected jointly to the positive terminal 14. The negative terminal 22 is connected to the corresponding contact 23.

A switching element 24, preferably a MOSFET, is connected into the line 21 which is connected to the positive terminal 14, which switching element can be driven via a microcontroller 25.

Once the rechargeable battery 10 has been connected, the microcontroller 25 checks whether proper contact between the plug, i.e. the lines 11 and 14, and the positive terminal 14 has been brought about. In this first contact stage, the MOSFET 24 is open, with the result that a low current flows merely via the current limitation element 12. If proper contact is established by the microcontroller 25, the microcontroller 25 drives the MOSFET 24 and closes the MOSFET 24. In this second contact stage, the maximum current then flows via the MOSFET 24.

I claim:

1. An outboard drive for a boat, comprising an electronically commutated electric motor, a power supply line and a contact-making apparatus operatively connected to the power supply line, for connecting a DC voltage source, wherein the contact-making apparatus has first and second contact stages in parallel, a current limitation element is connected between the DC voltage source and the power supply line in the first contact stage to permit capacitances in the outboard drive to be charged slowly without current peaks and charge current pulses, the contact-making apparatus has first and second connection contacts, the current limitation element is operatively connected to the first connection contact, a switching element is operatively connected to the second connection contact, and a control element is provided to drive the switching element as a function of the current flowing via the current limitation element.

2. The outboard drive as claimed in claim 1, wherein the outboard drive has a space for accommodating the DC voltage source.

3. The outboard drive as claimed in claim 1, wherein the outboard drive has a housing that houses at least part of the outboard drive, and a space for accommodating the DC voltage source is provided within the housing.

4. The outboard drive as claimed in claim 1, wherein the DC voltage source is connected directly to the power supply line in the second contact stage.

5. The outboard drive as claimed in claim 1, wherein the contact-making apparatus has first and second connections, and the current limitation element is operatively connected to the first connection.

6. The outboard drive as claimed in claim 2, wherein, when the DC voltage source is accommodated in the space, the drive is constructed such that initially the first contact stage of the contact-making apparatus and then the second contact stage are closed.

7. The outboard drive as claimed in claim 1, wherein the outboard drive comprises an upper part, an underwater part and a shaft connecting the upper part and the underwater part, and the housing houses at least part of either or both of the upper part and the shaft.

8. The outboard drive as claimed in claim 2, wherein the space for accommodating the DC voltage source is configured such that the DC voltage source can only be accommodated therein in a defined position.

9. The outboard drive as claimed in claim 1, wherein buffer capacitors are operatively associated with the electric motor.

* * * * *